United States Patent [19]

Failmezger et al.

[11] 4,419,853

[45] Dec. 13, 1983

[54] METHOD FOR TREATING THE SURFACE OF A METAL TO IMPROVE THE ADHESION OF A CEMENTITIOUS JOINT COMPOUND THERETO

[75] Inventors: Friedrich Failmezger, Schaumburg; Geronimo E. Lat, Skokie, both of Ill.

[73] Assignee: United States Gypsum Company, Chicago, Ill.

[21] Appl. No.: 305,071

[22] Filed: Sep. 24, 1981

[51] Int. Cl.[3] ..... C23F 11/00

[52] U.S. Cl. ..... 52/741; 148/6.11; 427/403; 427/406; 428/703; 428/623; 428/457

[58] Field of Search ..... 427/309, 327, 403, 307.1; 156/664; 252/79.1, 80; 428/703; 148/6.11; 52/741

[56] References Cited

U.S. PATENT DOCUMENTS 3,494,806 2/1970 Teumac ..... 148/6.11

OTHER PUBLICATIONS

United States Gypsum, *Red Book of Lathing & Plastering* 1967, pp. 34, 35, 50, 51, 52 and 53.

Cordova Chemical Co., XAMA ®-2 Publication, 1979.

*Primary Examiner*—John E. Murtagh

*Assistant Examiner*—Jr. Chilcot

*Attorney, Agent, or Firm*—Samuel Kurlandsky; Robert H. Robinson; Robert M. Didrick

[57] ABSTRACT

A composition and method for treating the surface of a metal structure adapted to be used for such purposes as a cornerbead and to have a cementitious material such as a joint compound applied to the surface thereto, the compound and composition and method resulting in the improvement of the adhesion between the surface of the metal structure and the cementitious compound applied thereto, which comprises preparing a composition such as that comprising a forming lubricant for processing the metal structure and a minor proportion of a polyfunctional aziridine incorporated therein. The presence of the aziridine enhances the adhesion properties between the surface of the metal and the cementitious compound even when less highly processed metals and less expensive compounds are utilized.

13 Claims, No Drawings

METHOD FOR TREATING THE SURFACE OF A METAL TO IMPROVE THE ADHESION OF A CEMENTITIOUS JOINT COMPOUND THERETO

BACKGROUND OF THE INVENTION (1) Field of the Invention

The present invention relates to structures used in buildings, and particularly relates to structures such as walls having a metal cornerbead provided which is subsequently covered by a joint compound.

(2) Description of the Prior Art

In the past it has been found necessary in order to provide improved adhesion between the surface of a metal cornerbead and a joint compound to process the metal cornerbead structure specially to enhance its adhesion properties. Additionally, specially designed and expensive joint compounds have been required to improve adhesion with the metal surface. However, even with such expedience, the adhesion between the joint compound and the metal cornerbead has still resulted in many adhesion failures.

SUMMARY OF THE INVENTION

It is accordingly an object of the present invention to provide a method for improving the adhesion between the surface of metal, particularly for use as a cornerbead, with a cementitious composition such as a joint compound provided thereover.

It is a further object to provide a method which does not require an additional step for processing the metal structure.

It is still an additional object to provide a composition which may be applied to a metal as it is being formed into a cornerbead structure, which improves the ability of the metal to have a joint compound applied thereto with substantially improved adhesion.

It is still an additional object to provide a method and composition as described which is relatively inexpensive and easy to apply.

Other objects and advantages of the invention will become apparent upon reference to the following description.

According to the invention, a thin film of a polyfunctional aziridine is applied to the surface of a metal, preferably galvanized steel. The aziridine may be applied either in one of the several solvents for aziridine or in a lubricant conventionally used to process the metal and form it into shape. As a result of the presence of the aziridine film on the surface of the metal, a joint compount subsequently applied to the surface of the metal exhibits greatly improved adhesion to the metal surface. Further, the use of the aziridine film on the metal permits a less expensive and less highly processed metal to be utilized with a joint compound while still obtaining excellent adhesion between the finally set joint compound and the surface of the metal structure.

DESCRIPTION OF THE PREFERRED EMBODIMENTS

In the process of constructing walls and ceilings from plaster or gypsum wallboard it is common to use metal cornerbead for reinforcing the outside corners. Such cornerbead is generally galvanized steel. Subsequently the cornerbead is covered with any of a variety of joint compounds formed of gypsum, calcium carbonate, and other material, i.e., topping, taping, or all purpose joint compounds.

Considerable difficulty has been experienced in obtaining suitable adhesion between the dried joint compound and the surface of the metal cornerbead. In order to improve adhesion it has been conventionl to form the cornerbead from a specially treated galvanized steel. Such steel has an alloy surface of the zinc and steel and is made by heating the zinc at a temperature considerably higher than that necessary to melt it. When the steel is subsequently dipped into the hot zinc bath, some of the steel is also melted and comes up out of the bath. A form of brush is utilized to wipe the metal surface and cause the steel and zinc to be mixed together so that the surface is a combination of zinc and steel. Although such a material provides better adhesion with the joint compound, it is more expensive to produce and is not readily available.

In the past adhesion between the joint compound and cornerbead surface has been somewhat improved by incorporating an additional amount of adhesive binder such as polyvinyl alcohol, starch, or polyvinyl acetate. However, the increase in adhesion resulting from the incorporation of a greater than normal amount of binder does not improve adhesion to a sufficient degree, and in addition causes the joint compound to become too hard to sand to a smooth surface. Additionally, the use of additional binder is expensive and thereby the cost of the joint compound is increased.

In accordance with the invention, a thin film of an aziridine is applied to the surface of the galvanized steel. This may be done in one of several ways. Although the aziridine may be rubbed onto the steel surface, this has not been found to be a practical method of application. Considerably better results are obtained by other methods of application. In one method aziridine is dissolved in hexylene glycol used as a forming lubricant in fabricating the cornerbead from galvanized steel sheet. Other lubricants in which the aziridine is soluble or miscible may be used. When this method is utilized the composition containing hexylene glycol and aziridine is applied to the surface of the galvanized sheet steel prior to fabrication of the cornerbead. The composition then serves as a lubricant during the forming process. After the forming process, a sufficient amount of aziridine remains on the surface of the galvanized steel in the form of a film. When a joint compound is subsequently applied to the surface of the cornerbead, excellent adhesion results after the joint compound has dried.

In Examples 1–4 varying proportions of aziridine were mixed together with hexylene glycol. The resulting compositions were each applied to a sheet of standard galvanized steel and the excess wiped off. In Example 5, the control, 100% hexylene glycol and 0% aziridine were used. The following Table I shows the compositions used in the various examples. The aziridine utilized was XAMA 7 produced by the Cordova Chemical Company. Similar results were obtained with XAMA 2 produced by the same company.

TABLE I

| Example: | 1 | 2 | 3 | 4 | 5 |
|---|---|---|---|---|---|
| Hexylene Glycol | 97.5 g | 95.0 g | 90.0 g | 85.0 g | 100.0 g |
| Aziridine | 2.5 g | 5.0 g | 10.0 g | 15.0 g | — |
| Total | 100.0 g | 100.0 g | 100.0 g | 100.0 g | 100.0 g |

The compositions of Examples 1-5 above were applied to the surface of a piece of galvanized steel. While the treated material was still wet, a standard all-purpose ready-mix joint compound was applied. The material was permitted to dry. After drying, adhesion tests were carried out by scraping the material to determine the degree of adhesion. In Table II below the results of the adhesion tests are set out.

TABLE II

| ADHESION OF JOINT COMPOUND | |
|---|---|
| Examples | Results |
| 1 | Good |
| 2 | Very Good |
| 3 | Very Good |
| 4 | Good |
| 5 | (Control) Poor |

Although hexylene glycol is the preferred material for preparing the coating composition, other materials may be utilized. Examples 6-12 were carried out utilizing various materials as a carrier for the aziridine. Table III below lists the compositions utilized in the various experiments.

TABLE III

| Examples | Composition | Parts (Grams) |
|---|---|---|
| 6 | Diethylene Glycol | 100.00 |
| | Aziridine | 7.50 |
| | | 107.50 |
| 7 | Dioctyl Pthalate (DOP) | 100.00 |
| | Aziridine | 7.50 |
| | | 107.50 |
| 8 | Propylene Glycol | 100.00 |
| | Aziridine | 7.50 |
| | | 107.50 |
| 9 | Tuflo Oil 500 | 100.00 |
| | Aziridine | 7.50 |
| | | 107.50 |
| 10 | Ethylene Glycol | 100.00 |
| | Aziridine | 7.50 |
| | | 107.50 |
| 11 | Soluble Oil (Cutting Oil) (1 part concentrate to 4 parts water) | 100.00 |
| | Aziridine | 7.50 |
| | | 107.50 |
| 12 | Soluble Oil (Cutting Oil) (1 part oil to 5 parts water) | 100.00 |
| | Aziridine | 7.50 |
| | | 107.50 |

After mixing, the solutions of Examples 6-12 were applied very thinly to unprocessed galvanized steel substrate by means of a rag. The material was permitted to dry at room temperature. A joint compound was then applied and permitted to dry. The joint compound was standard commercial joint compound marketed by United States Gypsum Company.

The results of the adhesion tests carried out by the method described in relation to Examples 1-5 are shown below in Table IV.

TABLE IV

| Example | Results |
|---|---|
| 6 | Good to Very Good |
| 7 | Very Good |
| 8 | Good |
| 9 | No Adhesion |
| 10 | Fair to Good |

The solutions of Examples 11 and 12 were not used since they were not sufficiently stable and gelled prior to use.

When a composition is used for treating the surface of a metal having greater than 15% aziridine, the resulting adhesion of the cementitious material deteriorates.

The amount of aziridine in the treating composition may be from about 2.5% to about 15%. An amount of from 5% to about 10% is optimum.

The aziridine and hexylene glycol composition or the other compositions shown in Examples 6-10 may also be applied to other metals such as bare steel, and the composition serves to improve the adhesion of materials such as joint compounds to the surface of the metal.

Although the aziridine utilized in the experiments described above was ethyleneimine, other aziridines may be utilized such as ethyl ethyleneimine, propyleneimine and 1-aziridineethanol.

Various liquids as described in Examples 6-10 may be used as carriers for the aziridine. It is necessary that the aziridine be soluble in the liquid or at least be miscible to form a stable solution or suspension. The preferred material is hexylene glycol. Other materials are dioctyl pthalate, propylene glycol, Tuflo Oil 500, a trademarked product, ethylene glycol and other similar materials in which the aziridine is either soluble or at least miscible to form a stable colloidal solution or suspension. The adhesion promoters of the present invention may be utilized with many cementitious products. The most widely used are all-purpose ready-mixed joint compounds, of the drying type. Such materials utilize fillers such as calcium sulfate dihydrate, or calcium carbonate, together with a binder such as polyvinyl acetate and a material such as attapulgus clay. Such materials are readily available in the market. Other materials which may be utilized are caulking compounds such as acrylic caulking compounds either water based or organic solvent based, and setting joint compounds utilizing calcium sulfate hemihydrate.

The composition and method of the present invention for improving the adhesion of cementitious materials to metal surfaces has many advantages. First, the composition may be applied by spraying, by wiping on, or by use of the composition as a forming liquid during the forming of the metal into various structures. The composition works so well that ordinary metals or galvanized steel may be utilized which are much cheaper than the specially treated galvanized steel which has been previously required for adequate adhesion. The composition is relatively inexpensive and readily applied. It may be dried before the cementitious mixture is applied, or the mixture may be applied even when the adhesion agent is still wet. The aziridine may be utilized with many different carrier liquids, among them being various liquids used as forming or cutting oils. It is only necessary be miscible with the liquid, that is either soluble in the liquids or able to form an emulsion or stable suspension therewith which will remain in that state over a reasonable period of time. It is to be understood that the invention is not to be limited to the exact composition or details of operation as shown and described, as obvious modifications and equivalents will be apparent to one skilled in the art.

It is to be understood that the invention is not to be limited to the exact details of construction, operation or materials or compositions shown and described, as obvious modifications and equivalents will be apparent to one skilled in the art.

Invention is claimed as follows:

1. A method for forming a building structure including a metal structure such as a cornerbead, which comprises forming said metal structure, applying an emulsion comprising a forming lubricant and an aziridine to said metal structure, mounting said metal structure, applying a joint compound to cover said metal structure, and permitting said joint compound to dry.

2. A method according to claim 1, wherein said aziridine is applied in admixture with a solvent.

3. A method according to claim 2, wherein said solvent is hexylene glycol.

4. A method according to claim 1, wherein said aziridine is ethyleneimine.

5. A method according to claim 1, wherein said aziridine is ethylethyleneimine.

6. A method according to claim 1, wherein said aziridine is propyleneimine.

7. A method according to claim 1, wherein said aziridine is polypropyleneimine.

8. A method according to claim 1, wherein said aziridine is 1-aziridineethanol.

9. A method according to claim 1, wherein said aziridine is present in an amount from about 2.5% to about 15% by weight of said amixture.

10. A method according to claim 1, wherein said aziridine is present in an amount of from about 5% to about 10% by weight of said admixture.

11. A method according to claim 1, wherein said aziridine is applied to the surface of said metal during the forming of said structure.

12. A method according to claim 1, wherein said metal is steel.

13. A method according to claim 1, wherein said metal is galvanized steel.

* * * * *